United States Patent [19]

Matsuyama et al.

[11] 4,370,051

[45] Jan. 25, 1983

[54] ACTUATING MEANS FOR SEPARATOR PAWL

[75] Inventors: Takashi Matsuyama, Hachioji; Hideyuki Kawazu, Tokyo, both of Japan

[73] Assignee: Olympus Optical Company Limited, Tokyo, Japan

[21] Appl. No.: 297,012

[22] Filed: Aug. 27, 1981

[30] Foreign Application Priority Data

Aug. 28, 1980 [JP] Japan ..... 55/121110[U]

[51] Int. Cl.[3] ..... G03G 15/00

[52] U.S. Cl. ..... 355/3 R; 271/308; 355/3 TR; 355/3 SH; 355/3 DR

[58] Field of Search ..... 355/3 R, 3 TR, 3 SH, 355/3 DR; 271/DIG. 2, 307, 308, 311

[56] References Cited

U.S. PATENT DOCUMENTS 4,045,135 8/1977 Doi et al. ..... 271/DIG. 2

4,065,120 12/1977 Imaizumi et al. ..... 271/DIG. 2

*Primary Examiner*—R. L. Moses

*Attorney, Agent, or Firm*—Fleit & Jacobson

[57] ABSTRACT

A actuating apparatus for an electrophotographic device having a photosensitive drum mountable through an opening of a sidewall of the device, a detachable lid to close the opening, and a separator pawl adapted to separate a recording paper from tight contact with the drum. The actuating apparatus includes an actuator secured to the separator pawl so as to move the separator pawl between an operating position substantially in contact with the drum and a retarded position away from the drum, a bias device normally urging the separator pawl to the retarded position, and a stopper integrally secured to the lid in such a manner that when the lid is attached in position to the sidewall, the stopper automatically engages the actuator so as to keep the separator pawl at the operating position, whereas when the lid is detached from the sidewall, the stopper disengages from the actuator so as to automatically move the separator pawl to the retarded position for clearing the path of the drum.

5 Claims, 6 Drawing Figures

ACTUATING MEANS FOR SEPARATOR PAWL

BACKGROUND OF THE INVENTION

1. Field of the Invention

This invention relates to an actuating means for a separator pawl which separates a recording sheet, such as recording paper, from tight contact with a photosensitive drum. More particularly, the present invention relates to an actuating means which is adapted to prevent the separator pawl from damaging the surface of a photosensitive drum when the photosensitive drum is mounted to or dismounted from an electrophotographic device.

2. Description of the Prior Art

Various procedures have been proposed and practiced for electrophotographic devices of the type in which a recording sheet such as recording paper is separated from a photosensitive drum after transferring a toner image formed on the surface of the photosensitive drum to the recording sheet in tight contact with the drum. The photosensitive drum of the electrophotographic device of the aforesaid type has to fulfill various functions, such as reliable separation of the recording sheet from the tight contact with the photosensitive drum, formation and transfer of copied image (toner picture) of high quality, ease of replacement, and so on.

A number of methods are known for separating the recording paper from the photosensitive drum, and of all the known methods those using a separator pawl are very reliable. In the method using the separator pawl, the reliable separation of the recording paper is ensured by providing a recess on that portion of the surface of the photosensitive drum where the separator pawl comes in contact therewith, so that the tip of the separator pawl enters the recess and comes in contact with the leading edge of the recording paper in tight contact with the photosensitive drum, the contact of the separator pawl with said recording paper being on the surface where the copied picture is transferred.

The service life of the photosensitive drum is shorter than those of other components of the electrophotographic device, so that the photosensitive drum is considered to be a consumable and comparatively frequent replacement of the photosensitive drum is necessary. In replacing the photosensitive drum with mechanisms of the prior art, the separator pawl and other peripheral elements of the photosensitive drum for the copying process are moved away from the photosensitive drum before starting the replacement.

In the aforesaid case of having the separator pawl disposed in the close proximity to the recess formed on the photosensitive drum, if the photosensitive drum is pulled out of the electrophotographic device before moving the pawl and other elements away from such photosensitive drum by mistake, both the surface of the photosensitive drum and the separator pawl are liable to damaged by scratching or the like. Thus, the separator pawl of the prior art has a shortcoming in that it has to be moved, possibly along with other peripheral elements disposed in the proximity of the photosensitive drum by separate steps which are different from the steps associated with the mounting and dismounting of the photosensitive drum, and such separate steps tend to make the replacement of the photosensitive drum cumbersome and complicated.

SUMMARY OF THE INVENTION

Therefore, an object of the present invention is to obviate the aforesaid shortcoming of the prior art by providing an improved actuating means for the separator pawl. With the actuating means of the invention, the separator pawl can be moved easily in a reliable fashion, so that both the surface of the photosensitive drum and the separator pawl are protected against damage due to accidental contact of the separator pawl with the photosensitive drum during the mounting and dismounting of the photosensitive drum relative to an electrophotographic device.

To fulfil the aforesaid object, the present invention provides an actuating means for the separator pawl of an electrophotographic device having a photosensitive drum to be mounted and dismounted through an opening of sidewall of the device. A lid is detachably attached on the sidewall so as to close said opening, and a separator pawl is adapted to separate a recording sheet from tight contact with the photosensitive drum. The actuating means comprises a holder holding the separator pawl. The holder is movable between a position for holding the separator pawl at an operating position thereof in the close proximity to the photosensitive drum and another position for holding the separator pawl at a retarded position thereof away from the drum. A bias means urges the separator pawl toward the retarded position thereof. A actuating member is secured to the holder, and a stopping member is integrally secured to the lid so as to be engageable with the actuating member in such a manner that, when the lid is attached on the sidewall in position, the stopping member comes into operative engagement with the actuating member and keeps the separator pawl at the operating position thereof, whereas when the lid is detached from the sidewall the stopping member disengages from the actuating member and allows the bias means to move the separator pawl toward the retarded position thereof.

In a preferred embodiment of the invention, the actuating member is formed by securing a swing lever to the holder of the separator pawl, and the stopping member is formed by integrally securing a stopper to the lid at the position where the stopper comes into the operating engagement with the swing lever when the lid is attached in position on the sidewall.

In another embodiment of the invention, the actuating member is formed by integrally securing a grooved cam to the holder, and the stopping member is formed by integrally mounting a pin to the lid at the position where the pin engages and moves the grooved cam so as to keep the separator pawl at the operating position when the lid is attached in position on the sidewall.

A preferred form of the holder of the separator pawl is a rotary shaft journalled by the electrophotographic device, which rotary shaft has the separator pawl integrally secured thereto.

The bias means of the actuating means of the separator pawl can be the moment of inertia of the separator pawl itself about the axis of rotation of the rotary shaft having the separator pawl integrally secured thereto.

BRIEF DESCRIPTION OF THE DRAWINGS

For a better understanding of the invention, reference is made to the accompanying drawings, in which.

Throughout different views of the drawings, 1 is an original, 2 and 3 are feeding rollers, 4 is an illuminating lamp, 5 is an optical system, 6 is a photosensitive drum, 6a is a groove in the photosensitive drum, 7 is a deelectrifying lamp, 8 is a corona electrifier, 9 is a toner developing unit, 10 is a toner image transfer station, 11 is a recording paper cassette, 12 is a recording paper, 13 is a pickup roller, 14 and 16 are paper guides, 15 is register rollers, 17 is a semiconductive transfer roller, 18 is a pin, 19 is an arm, 20 is a spring, 21 is a separator pawl, 21a is a pawl tip, 22 is a paper guide, 23 is feeding rollers, 24 is a thermal fixing unit, 25 is discharge rollers, 26 is a tray, 27 is a cleaner brush, 28 is a fan, 29 is a filter, 30 is a housing, 32 and 34 are sidewalls, 33 is a support spindle, 35 is a setscrew, 36 is a lid, 37 is a circular opening, 39 is a drive gear for the photosensitive drum, 40 is a swing shaft, 41 and 42 are bearings, 44 is a swing lever, 45 is a stopper, 46 is an annular groove, 47 is an E ring, 49 is a stopper pin, 51 is a bearing, 53 is a cam surface, 55 is a grooved cam, 56 is a pin, 57 is a cam roller, and 58 is a stopper pin.

DESCRIPTION OF THE PREFERRED EMBODIMENT

Figure 1:
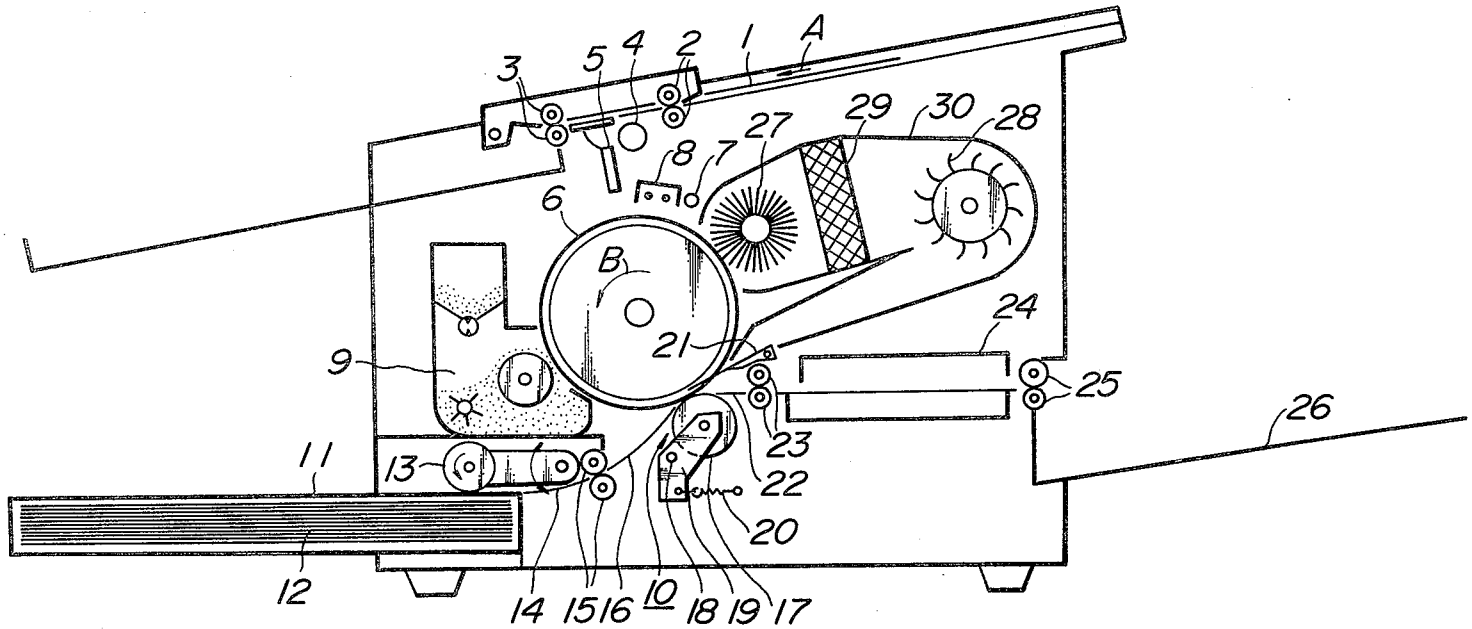
FIG. 1 is a schematic sectional view of an electrophotographic device, i.e., a copying apparatus, to which the present invention is applied.

FIG. 1 schematically shows the construction of an electrophotographic copying apparatus to which the present invention is applied. When a sheet-like original 1 to be copied is placed on an inclined original table and moved in the direction of the arrow A, two pairs of feeding rollers 2 and 3 act to forward the original 1. When moving between the feeding rollers 2 and 3, the original 1 passes above an illuminating lamp 4 and an optical system 5. The optical system 5 projects an image of the illuminated original 1 onto a rotary photosensitive drum 6. The photosensitive drum 6 rotates in the direction of the arrow B, and after being de-electrified by a de-electrifying lamp 7, the photosensitive drum 6 is uniformly electrified by a corona electrifier 8, so that upon projection of the aforesaid image of the original 1, an electrostatic latent image is formed thereon. This latent image is toner developed by a toner developing unit 9, and then the developed image is forwarded to a toner image transfer station 10 as the photosensitive drum 6 rotates.

On the other hand, a recording paper cassette 11 carries plural sheets of recording paper 12. A swaying rotary pickup roller 13 picks up the recording paper 12 one sheet at a time, so as to feed the recording paper 12 to the toner image transfer station 10 through a paper guide 14, register rollers 15, and another paper guide 16. In the toner image transfer station 10, the recording paper 12 passes between the photosensitive drum 6 and a semiconductive transfer roller 17 being provided with a bias voltage, so that the recording paper 12 overlies the aforesaid toner image and causes the toner image to be transferred to the recording paper 12. The transfer roller 17 is journalled at one end of an arm 19 pivotally supported by a pin 18 fixed to the copying apparatus, and a spring 20 is connected between the opposite end of the arm 19 and a stationary portion of the copying apparatus.

When the recording paper 12 is at the toner image transfer station 10, the spring 20 acts to urge the transfer roller 17 against the photosensitive drum 6. However, during the remaining period of the copying operation, the transfer roller 17 is separated from the photosensitive drum 6 by a suitable means such as a solenoid (not shown). During this transferring process, the recording paper 12 moves in tight contact with the surface of the photosensitive drum 6 in the toner image transfer station 10, and a separator pawl 21 acts to separate the recording paper 12 from the drum 6 in cooperation with an air flow. A paper guide 22 directs the separated recording paper 12 to feed rollers 23 which feed the recording paper 12 to a thermal fixing unit 24 for fixing the toner image by heating. Discharge rollers 25 discharge the recording paper 12 with the fixed toner image onto a tray 26. Since the toner image on the photosensitive drum 6 is not completely transferred to the recording paper 12 and partially remains on the drum 6, a rotary cleaner brush 27 brushes off the residual toner from the photosensitive drum 6 after the toner image passes through the toner image transfer station 10. A fan 28 generates as air flow to suck the thus brushed off toner, and a filter 29 collects the toner particles from the air flow. A housing 30 encloses the cleaner brush 27 and the fan 28 to produce an effective suction for sucking the toner and to prevent the toner particles from being scattered in the apparatus. The housing 30 further defines a duct to guide the exhaust from the fan 28.

Figure 2:
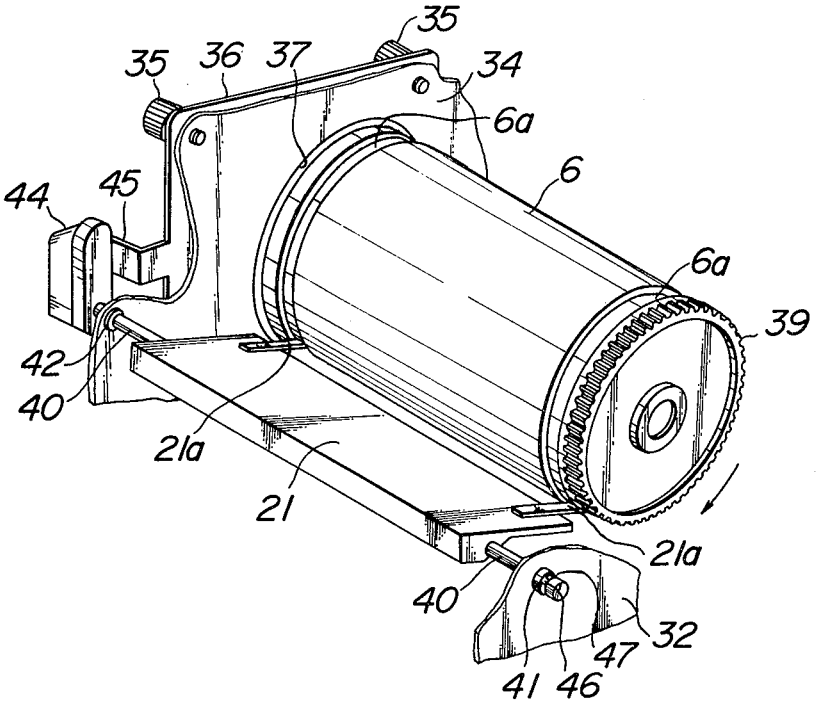
FIG. 2 is a cutaway perspective view showing the details of the peripheral elements of a photosensitive drum in the electrophotographic device of FIG. 1.

Referring to FIG. 2 showing a cutaway perspective view of the details of the peripheral elements of the photosensitive drum 6 of the copying apparatus, two grooves 6a are formed on the circumferential surface of the photosensitive drum 6, i.e., one groove 6a at each longitudinal end of the drum 6. Pawl tips 21a of the separator pawl 21 can be fitted in the grooves 6a. The photosensitive drum 6 has a central hole which fits on a support spindle 33 (see FIG. 3) secured to a sidewall 32 of support frame (to be referred to as "sidewall 32" hereinafter) of the copying apparatus, so that the photosensitive drum 6 is rotatably held by the support spindle 33. A lid 36 is detachably secured on the opposite sidewall 34 of the support frame (to be referred to as "sidewall 34" hereinafter) to sidewall 32 by setscrews 35. Thrust of a certain magnitude is applied to the photosensitive drum 6 between sidewall 32 and the lid 36, so as to axially register the photosensitive drum 6. A circular opening 37 is bored through sidewall 34 in such a manner that the photosensitive drum 6 can be mounted to and dismounted from the copying apparatus through the circular hole 37. The lid 36 is adapted to close the opening 37 from outside of the space between the two sidewalls 32 and 34. A drive gear 39 for driving the photosensitive drum 6 is secured to that end of the photosensitive drum 6 which is on the side of sidewall 32, and the drive gear 39 meshes a gearing mechanism (not shown) of the copying apparatus so that the photosensitive drum 6 is rotated in the direction of the arrow of FIG. 2. The separator pawl 21 is secured to a swing shaft 40. Bearings 41 and 42 mounted on the sidewalls 32 and 34 journal the swing shaft 40 at opposite ends thereof. In the illustrated embodiment, the separator pawl 21 has pawl tips 21*a* disposed at positions corresponding to the grooves 6*a* of the photosensitive drum 6.

One end of the swing shaft 40 extends from the bearing 42, and a swing lever 44 is fixed to the thus extended end of the swing shaft 40. The tip of the swing lever 44 selectively engages a stopper 45 fixed to the lid 36, and when the stopper 45 engages the tip of the swing lever 44, the swing lever 44 and the swing shaft 40 assume such angular positions that the separator pawl 21 secured to the swing shaft 40 is brought to an operating position thereof and the pawl tips 21*a* of the separator pawl 21 fit in the grooves 6*a* of the photosensitive drum 6.

The end of the swing shaft 40, opposite the swing lever 44, slightly projects from the bearing 41, and an annular groove 46 is formed on the circumference of the thus projected portion of the swing shaft 40. An E ring 47 is fitted in the annular groove 46, so that the swing shaft 40 is prevented from moving in the longitudinal axial direction thereof. A stopper pin 49 is fixed to the sidewall 34 so as to restrict the angular movement of the swing lever 44 (see FIG. 3).

Figure 3:
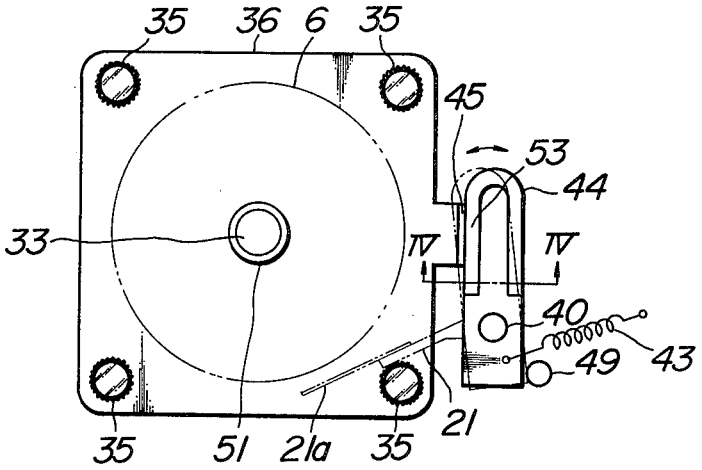
FIG. 3 is a schematic side view showing the details of a support frame sidewall and a swing lever illustrated in FIG. 2.

Referring to FIG. 3 showing a side view of the details of the lid 36 and the swing lever 44, a bearing 51 is formed at the central portion of the lid 36, so that the free end of the support spindle 33 extending through the photosensitive drum 6 fits in the bearing 51 and is supported thereby. Thus, the extreme ends of the support spindle 33 are held by the sidewalls 32 and 34 in the copying apparatus.

Figure 4:
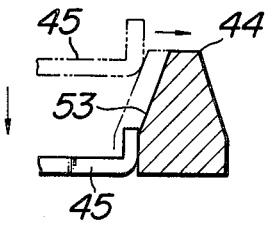
FIG. 4 is a fragmentary sectional view taken along the line IV—IV of FIGS. 3.

A cam surface 53 is formed on that portion of the swing lever 44 which engages the stopper 45, as shown in FIGS. 3 and 4. The position of the stopper pin 49 is selected so as to fulfil the following two functions: namely, when the lid 36 is attached on the sidewall 34, the tip of the stopper 45 of the lid 36 engages the cam surface 53 of the swing lever 44 at first; and when the photosensitive drum 6 is removed through the circular opening 37, the pawl tips 21*a* of the separator pawl 21 are cleared from the path of the photosensitive drum 6 and prevented from coming in contact with the photosensitive drum 6. The function of the cam surface 53 is as follows; namely, when the lid 36 is attached on the sidewall 34, the stopper 45 of the lid 36 engages the cam surface 53, and as the lid 36 moves toward the sidewall 34, the cam surface 53 is pushed away from the support spindle 33 by the engagement between the cam surface 53 and the stopper 45, so that the swing lever 44, the swing shaft 40 and the separator pawl 21 are turned clockwise as seen in FIG. 3, until the pawl tips 21*a* fit in the grooves 6*a* of the photosensitive drum 6 in position. On the other hand, when the lid 36 is detached from sidewall 34 and the engagement between the stopper 45 of the lid 36 and the swing lever 44 is released, the separator pawl 21 turns counterclockwise as seen in FIG. 3. This counterclockwise turn of the separator pawl 21 is actuated either naturally by the weight of the separator pawl 21 itself or forcedly by a suitable bias means such as a spring 43.

The operation mounting and dismounting the photosensitive drum 6 in the aforesaid embodiment will be explained now.

To remove the photosensitive drum 6 from the copying apparatus, the setscrews 35 are loosened and taken away. When the lid 36 is detached from the support spindle 33, the stopper 45 of the lid 36 is released from the engagement with the cam surface 53 of the swing lever 44. Accordingly, the swing lever 44 and the separator pawl 21 turn counterclockwise about the axis of rotation of the swing shaft 40 as seen in FIG. 3, until the pawl tips 21*a* of the separator pawl 21 move away from the grooves 6*a* of the photosensitive drum 6. The aforesaid counterclockwise turn is restricted by the stopper pin 49. Consequently, the photosensitive drum 6 can be removed through the circular opening 37 of the sidewall 34 without any contact with the separator pawl 21.

To mount the photosensitive drum 6 on the copying apparatus, the photosensitive drum 6 is fitted on the support spindle 33 through the circular opening 37 of sidewall 34. When the lid 36 is fitted on the support spindle 33 at the bearing 51, the stopper 45 of the lid 36 engages the cam surface 53 of the swing lever 44 so as to push the cam surface 53 to the right as seen in FIG. 4. Accordingly, the swing lever 44 turns clockwise about the axis of rotation of the swing shaft 40 as seen in FIG. 3, so that the pawl tips 21*a* of the separator pawl 21 fit in the grooves 6*a* of the photosensitive drum 6 in position. Thereafter, the lid 36 is secured to the sidewall 34 by tightening the setscrews 35.

Figure 5:
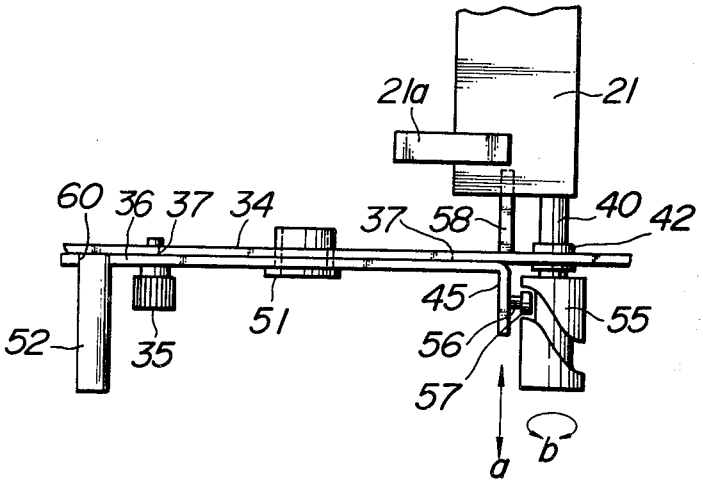
FIG. 5 is a schematic partial plan view showing an essential portion of another embodiment of the present invention.
Figure 6:
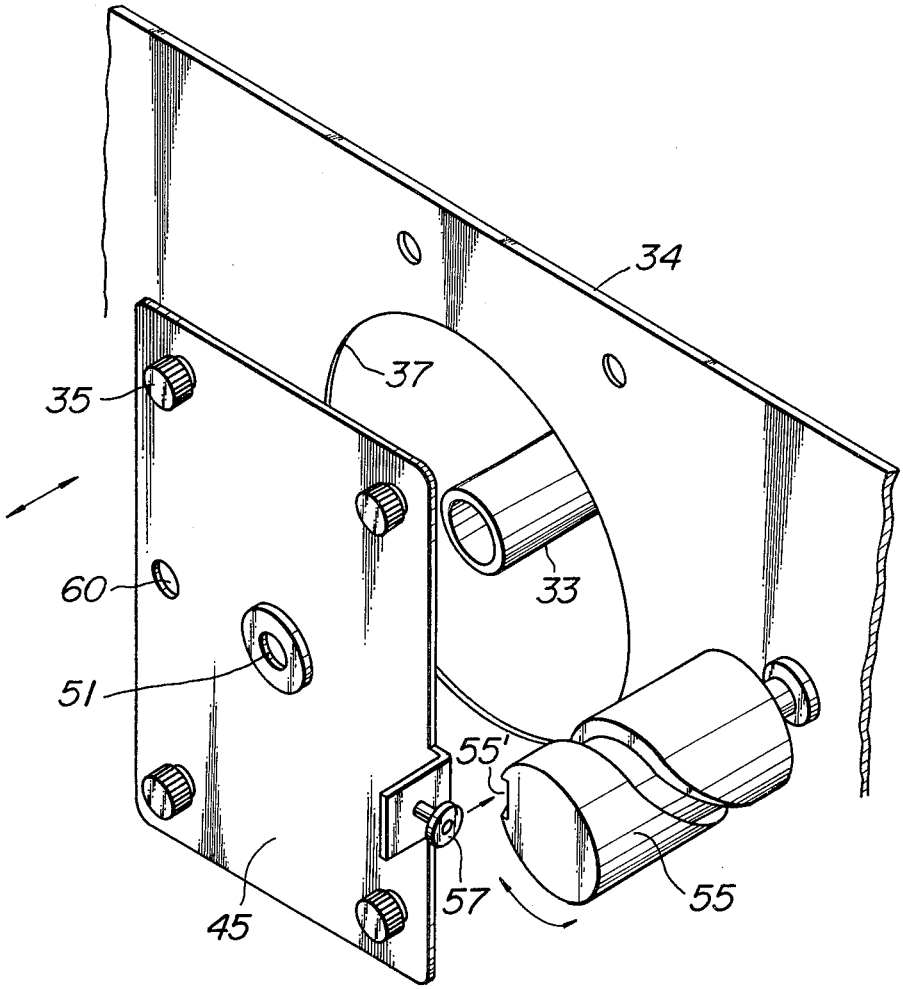
FIG. 6 is an exploded perspective view showing a main portion of the apparatus illustrated in FIG. 5.

FIG. 5 shows a cutaway partial plan view of another embodiment of the present invention. In this embodiment, the swing lever 44 of the preceding embodiment is replaced by a grooved cam 55 fixed to that portion of the swing shaft 40 which extends away from the bearing 42. A pin 56 is secured to that edge of the stopper 45 of the lid 36 which faces the grooved cam 55, and a cam roller 57 is rotatably mounted on the tip of the pin 56. To restrict the swing of the separator pawl 21, a stopper pin 58 extends from the sidewall 34 to a position below the separator pawl 21 as seen in FIG. 5. As clearly shown in FIG. 6, a guide pin 52 is secured to the sidewall 34 and the lid 36 has formed therein a guide hole 60 through which said guide pin 52 can be inserted. In this manner, the cam roller 57 can be positively prevented from being removed out of a groove 55' of the cam 55.

In operation of the embodiment of FIG. 5, when the lid 36 is attached on or detached from the sidewall 34, the cam roller 57 mounted at the tip of the pin 56 secured to the stopper 45 of the lid 36 fits in the groove of the grooved cam 55. Accordingly, as the lid 36 reciprocates in the direction of the arrow a, the grooved cam 55 turns as shown by the arrow b so as to cause both the swing shaft 40 and the separator pawl 21 to swing, so that the pawl tips 21*a* of the separator pawl 21 move into or out of the grooves 6*a* of the photosensitive drum 6 in the same manner as that of the preceding embodiment. More particularly, when the lid 36 is attached onto the sidewall 34, the pawl tips 21*a* fit into the grooves 6*a* of the photosensitive drum 6 in position, whereas when the lid 36 is detached from the sidewall 34, the pawl tips 21*a* move out of the grooves 6*a* of the photosensitive drum 6 until being restricted by the stopper pin 58. Consequently, the photosensitive drum 6 can be mounted to and dismounted from the copying apparatus through the annular opening 37 of the sidewall 34 without contacting with the separator pawl 21.

As previously discussed, in the actuating means of the separator pawl according to the present invention, the separator pawl is automatically removed from the grooved portion of the photosensitive drum simply by detaching the lid for the photosensitive drum from the sidewall in the copying apparatus without necessitating any operations which are apart from the physical removal of the photosensitive drum. The separator pawl is automatically fitted in the grooved portion of the photosensitive drum in proper position simply by attaching the lid for the photosensitive drum to the sidewall in the copying apparatus. In this way the photosensitive drum can be easily mounted and dismounted without any risk of contacting with the separator pawl simply by attaching and detaching the lid for the photosensitive drum relative to the sidewall in the copying apparatus. Thus, the operation of mounting and dismounting the photosensitive drum is simplified to a great extent, and the risk of damaging the photosensitive drum by the separator pawl due to a mistake in the sequence of operational steps for mounting and dismounting the photosensitive drum is eliminated. Furthermore, the actuating means of the separator pawl according to the present invention has an advantage in that, since the mechanism to move the separator pawl is actuated independently of the mechanism for moving a transfer roller, even if the transfer roller is moved away from the photosensitive drum upon occurrence of jamming of recording paper or the like, the separator pawl is kept in position within the close proximity of the grooved portion of the photosensitive drum, so that the feeding of the recording paper being processed in the neighborhood of the separator pawl is not disturbed.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. An actuating apparatus for a separator pawl of an electrophotographic device having a photosensitive drum to be mounted and dismounted through an opening of a sidewall of said device, a lid detachably attached on said sidewall for closing said opening, and a separator pawl adapted to separate a recording sheet from tight contact with said photosensitive drum, said actuating apparatus comprising:

a holder holding said separator pawl which holding means is movable between a position for holding said separator pawl at an operating position thereof in the proximity of said photosensitive drum and another position for holding said separator pawl at a retarded position thereof away from said photosensitive drum;

a bias means urging said separator pawl toward said retarded position thereof;

an actuating member secured to said holder; and a stopping member integrally secured to said lid so as to be engageable with said actuating member in such a manner that, when said lid is attached on said sidewall in position, said stopping member comes into operative engagement with said actuating member and keeps said separator pawl at said operating position thereof, whereas, when said lid is detached from said sidewall, said stopping member disengages from said actuating member and allows said bias means to move said separator pawl toward said retarded position thereof.

2. The actuating apparatus as set forth in claim 1, wherein said actuating member is a swing lever integrally secured to said holder and said stopping member is a stopper integrally formed with said lid at such position where the stopper comes into said operative engagement with said swing lever when said lid is attached in position on said sidewall.

3. The actuating apparatus as set forth in claim 1, wherein said actuating member is a grooved cam integrally secured to said holder and said stopping member is a pin integrally formed with said lid at such position wherein the pin engages and moves said grooved cam so as to keep said separator pawl at said operating position thereof when said lid is attached in position on said sidewall.

4. The actuating apparatus as set forth in claim 1, wherein said holder is a rotatable shaft journalled by said electrophotographic device, said rotatable shaft having the separator pawl integrally secured thereto.

5. The actuating apparatus as set forth in claim 4, wherein said bias means is the weight of said separator pawl whose moment of inertia about the axis of rotation of said rotatable shaft is toward said retarded position of said separator pawl.

* * * * *